US007047684B2

(12) United States Patent
Röh

(10) Patent No.: US 7,047,684 B2
(45) Date of Patent: May 23, 2006

(54) SHORT REPEATER RIFLE

(75) Inventor: Horst Röh, Eckemförde (DE)

(73) Assignee: J.P. Sauer & Sohn GmbH Gegr. 1751, Eckemförde (DE)

( * ) Notice: Subject to any disclaimer, the term of this patent is extended or adjusted under 35 U.S.C. 154(b) by 62 days.

(21) Appl. No.: 10/716,390

(22) Filed: Nov. 18, 2003

(65) Prior Publication Data

US 2004/0244261 A1 Dec. 9, 2004

Related U.S. Application Data

(63) Continuation of application No. PCT/DE02/01186, filed on Apr. 2, 2002.

(30) Foreign Application Priority Data

Jun. 1, 2001 (DE) ..... 101 26 761

(51) Int. Cl.
*F41A 3/00* (2006.01)

(52) U.S. Cl. ..... 42/16; 42/18

(58) Field of Classification Search ..... 42/18, 42/16

See application file for complete search history.

(56) References Cited

U.S. PATENT DOCUMENTS 2,302,699 A * 11/1942 Klipsch ..... 42/97
3,340,641 A * 9/1967 Recker ..... 42/97
4,463,654 A * 8/1984 Barnes et al. ..... 89/128
4,651,455 A * 3/1987 Geiser, Jr. ..... 42/18
4,856,410 A * 8/1989 Anderson ..... 89/161
4,932,148 A * 6/2000 Barrett ..... 42/18
RE35,381 E * 11/1996 Rose ..... 89/14.3
5,628,137 A * 5/1997 Cortese ..... 42/105
5,698,810 A * 12/1997 Rose ..... 89/14.3
5,704,155 A * 1/1998 Primeau, IV ..... 42/114
5,794,374 A * 8/1998 Crandall ..... 42/97
5,834,678 A * 11/1998 Kalb ..... 89/187.01
6,019,024 A * 2/2000 Robinson et al. ..... 89/1.42
6,226,915 B1 * 5/2001 Kotsiopoulos ..... 42/71.02
6,481,144 B1 * 11/2002 Chee et al. ..... 42/76.01

FOREIGN PATENT DOCUMENTS

BE 508 018 A 1/1952
DE 26 30 213 1/1978
GB 643 842 A 9/1950
GB 1 060 144 A 4/1981
GB 2 083 598 3/1982

* cited by examiner

*Primary Examiner*—M. Clement
(74) *Attorney, Agent, or Firm*—Martin Fleit; Paul D. Bianco; Fleit Kain Gibbons Gutman Bongini & Bianco, P.L.

(57) ABSTRACT

Short repeater rifle with a barrel, which has on one of its ends a cartridge receiver; a locking system; a trigger assembly with a trigger and a trigger guard; a firing mechanism; a magazine; and a targeting device, characterized in that the center of gravity of the short repeater rifle lies in front of the trigger guard in the shooting direction.

12 Claims, 5 Drawing Sheets

SHORT REPEATER RIFLE

RELATED APPLICATION

This application is a continuation of International Application PCT/DE02/01186, filed Apr. 2, 2002, the contents of which are here incorporated in their entirety.

BACKGROUND OF THE INVENTION

1. Field of the Invention

The present invention relates to a short repeater rifle with a barrel, which has on one of its ends a cartridge receiver; a locking system; a trigger assembly with a trigger and a trigger guard; a firing mechanism; a magazine; and a targeting device.

2. Prior Art

For such short repeater rifles, which are also called bull pups, the barrel with the locking system and the magazine are set farther back towards the butt stock relative to classical repeater rifles in order to obtain a weapon that is as short and portable as possible. However, this inevitably also leads to a backwards displacement of the mass and thus of the center of gravity with the disadvantage that such short repeater rifles are significantly less favorable than classical repeater rifles in terms of shooting and handling.

SUMMARY OF THE INVENTION

Thus the invention is based on the task of creating a short repeater rifle, for which these disadvantages should not appear at all, but are at least reduced.

For the short repeater rifles according to this type, this task is accomplished according to the invention such that the center of gravity of the short repeater rifle lies in front of the trigger guard in the shooting direction. This can be achieved by configuring essential structural elements so that their mass is set farther forwards towards the barrel opening.

According to a preferred embodiment of the invention, a weapon base can be provided as a carrier for the barrel and for the locking system, and the barrel is connected detachably to the weapon base in front of the cartridge receiver in the shooting direction. Through a weapon base independent of the stock and because the barrel is connected to the stock, instead of the conventional direct connection to the locking system lying behind the cartridge receiver, not only is the center of gravity of the short repeater rifle moved forwards, but there is also better shooting performance due to reduced barrel vibration and a simpler barrel exchange.

More favorably, the barrel is connected detachably to the weapon base not in front of the center of the length of the barrel in the shooting direction.

Advantageously, the barrel is connected to the weapon base by means of a prismatic clamping joint.

Alternatively, the barrel can be connected to the weapon base by means of a cylindrical clamping joint.

On the other hand, the barrel can also be connected to the weapon base by means of a screw connection.

According to another preferred embodiment of the invention, a mount for the targeting device can be mounted detachably on the barrel in the region of the connection between the barrel and the weapon base. Here, the term targeting device is understood to be, e.g., a targeting telescope or a lighted spot sighting device. Through such a configuration, the center of gravity of the short repeater rifle is shifted farther forward and a simpler barrel exchange is enabled, wherein the meeting point position does not change for a barrel exchange with its associated targeting device.

Advantageously, the trigger assembly with the trigger is arranged in front of the magazine in the shooting direction. Therefore, likewise a single or an additional displacement of the center of gravity of the short repeater rifle is achieved. Here, the magazine itself must be positioned behind the cartridge receiver of the barrel as required by function.

In particular, here the trigger can be configured as a catchless toggle lever and the trigger assembly can have a trigger lug, which is spatially separated from the toggle lever trigger, which is arranged behind the trigger in the shooting direction, and which is connected to the toggle lever trigger by a connecting rod.

According to another special embodiment of the invention, the drive of the firing mechanism can be arranged in front of the magazine in the shooting direction. Therefore, a "correction" of the firing mechanism is achieved, which produces a single or an additional displacement of the center of gravity of the short repeater rifle.

In particular, the firing mechanism can have a striker lever without a catch element.

More favorably, the firing mechanism has a striker spring, which is configured as a tension spring. The use of a tension spring means less friction, therefore less spring force for more reliable firing, consequently less wear and lower handling forces.

According to another special embodiment of the invention, the firing mechanism can include a sliding block with a holding catch, a connecting rod of arbitrary length, and a cocking lever, wherein the trigger assembly and the firing mechanism are configured so that the force of the striker spring in the tensioned state is held by the trigger lug in connection with the sliding block behind the striker spring and the striker spring drives the striker lever by means of a connecting rod and also the striker lever is brought into a striking position for a repeating process and is held in the striking position by the trigger lug engaged in the holding catch on the sliding block, wherein the striker spring can be tensioned and relaxed by hand by the cocking lever. Here, the striker spring is the connecting element to the cocking lever and the sliding block takes over the function of a catch element instead of the cocking lever.

Advantageously, the locking system includes a straight-line tension lock.

In particular, it can have a forestock and the straight-line tension lock can be operated by means of a ridged grip on the forestock.

Finally, the straight-line tension lock can be operated by means of a lever that can be mounted on the left or right in the shooting direction.

The invention is based on the knowledge that by moving the center of gravity of the short repeater rifle in front of the trigger guard in the shooting direction, weight at the rear can be eliminated and a properly balanced rifle with a nearly unchanged weight and short dimensions can be achieved.

BRIEF DESCRIPTION OF THE DRAWINGS

Additional features and advantages of the invention can be gathered from the claims and the following description, in which embodiments are explained in detail with reference to the drawings. Shown are:

DETAILED DESCRIPTION OF PREFERRED EMBODIMENTS OF THE INVENTION

Figure 1:
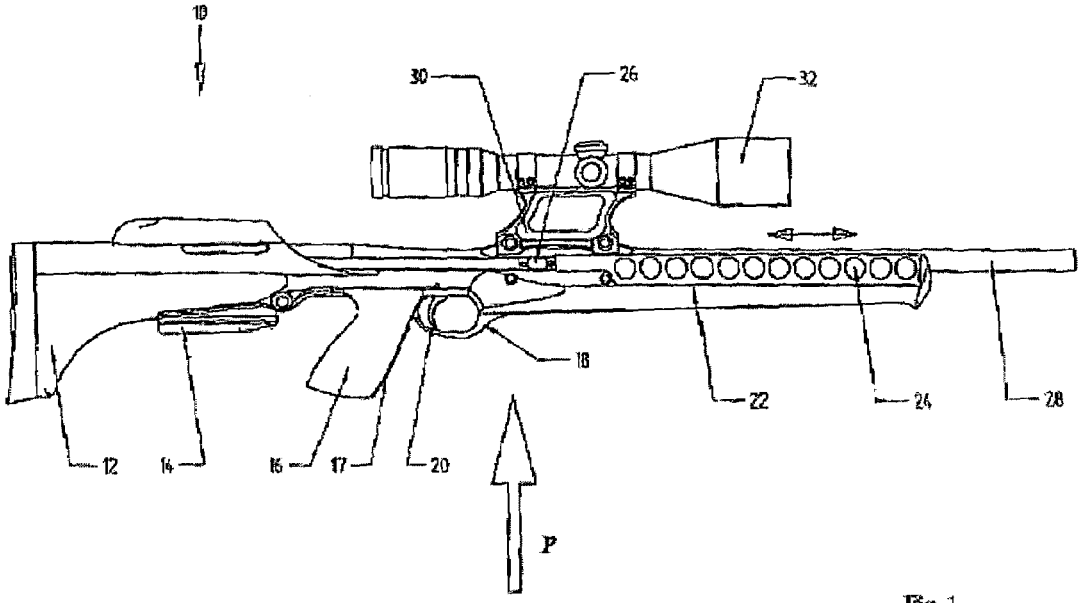
FIG. 1, a side view of a short repeater rifle according to a special embodiment of the invention.

FIG. 1 shows a side view of a short repeater rifle 10. For a barrel length of 650 mm, it has a total weapon length of only 880 mm and a weight (without targeting telescope) of less than 3.4 kg and is easily transportable due to the center of gravity lying in front of the trigger guard in the shooting direction. The short repeater rifle 10 has a main stock 12, a magazine 14, a pistol handle 16, a trigger guard 18, a trigger 20, a forestock 22 with a ridged grip 24, a lever 26 that can be mounted on the right or left, and a barrel 28, on which there is a mount 30 and a targeting telescope 32. It can be repeated by moving the ridged grip 24 (in the shooting direction (closing) and against the shooting direction (opening)) or by the lever 26. For this purpose, it has a straight-line tension lock. As specified by the large arrow P, the center of gravity of the short repeater rifle 10 is located in front of the trigger guard 18 in the shooting direction.

Figure 2:
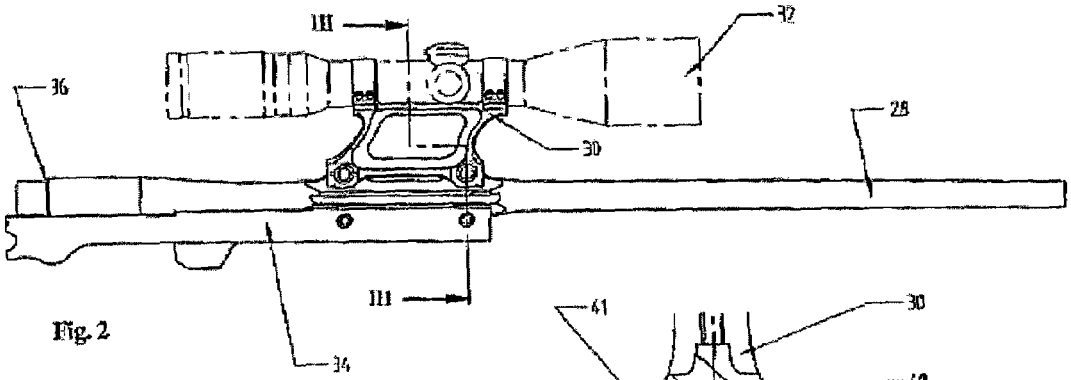
FIG. 2, a side view of the weapon base with barrel, mount, and targeting telescope of the short repeater rifle of FIG. 1.

FIG. 2 shows a side view of a weapon base 34 of the short repeater rifle 10 of FIG. 1. The weapon base 34 consists of aluminum or plastic for reasons of weight and is used as a carrier for the barrel 28 with the locking system, the mount 30, and the targeting telescope 32. The barrel 28 has at its rear end a lock 36.

Figure 3:
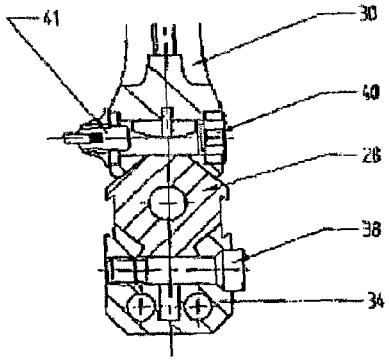
FIG. 3, a section view along line III—III of FIG. 2.

FIG. 3 shows a section view along line III—III of FIG. 2. It can be seen that the barrel 28 is mounted on the weapon base 34 by means of a locking screw 38. In turn, the mount 30 is attached onto the barrel 28 by means of a clamping lever 41 in connection with a nut 40.

Figure 4:
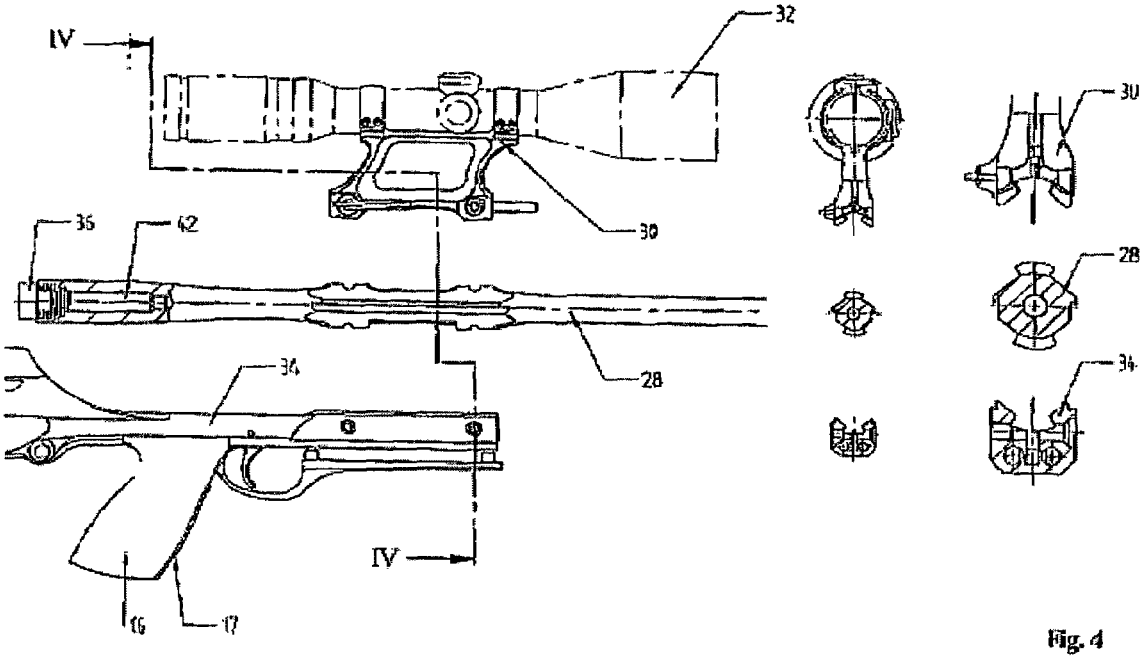
FIG. 4, an exploded view of a part of the short repeater rifle of FIG. 1 next to a section view along line IV—IV.

FIG. 4 shows an exploded view of a part of the short repeater rifle of FIG. 1 next to a section view along line IV—IV. It can clearly be seen that the barrel 28 is connected to the weapon base 34 by means of a prismatic clamping joint. This also applies for the connection between the mount 30 and the barrel 28. In addition, it can also be seen that a cartridge receiver 42 and the lock 36 of the barrel 28 are located on the rear end of the barrel 28.

Figure 5:
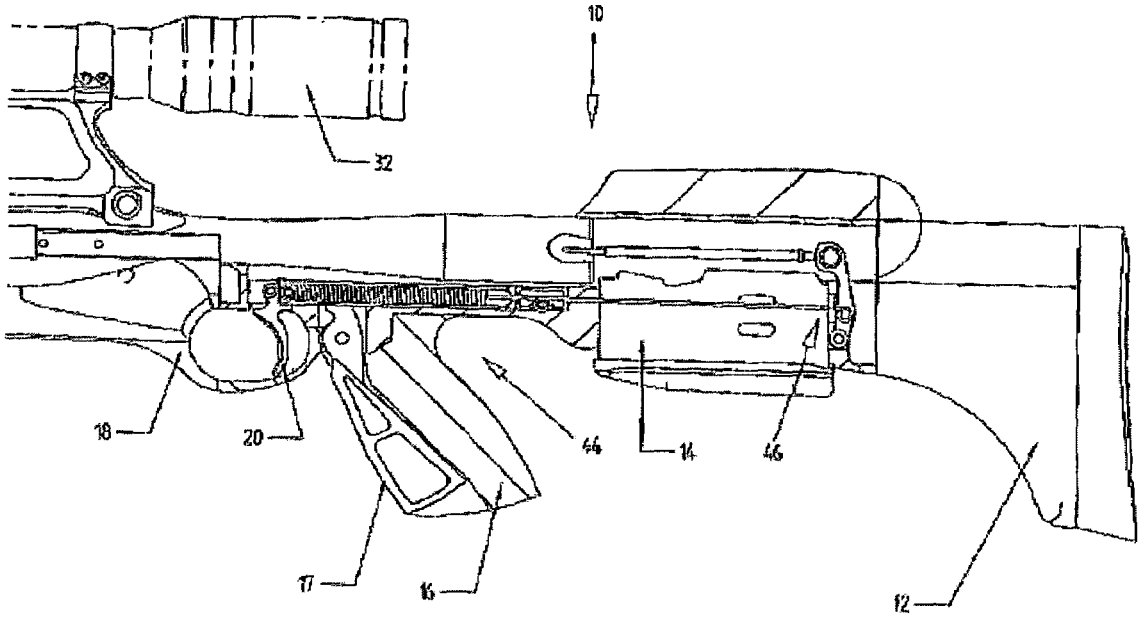
FIG. 5, the trigger assembly and the firing mechanism of the short repeater rifle of FIG. 1.

FIG. 5 shows a trigger assembly 44 and a firing mechanism 46 of the short repeater rifle of FIG. 1. The cocking lever 17 supported in the pistol handle 16 is used for tensioning or relaxing the firing system, as explained in the following. The trigger assembly 44 and the firing mechanism 46 are arranged in front of the magazine 14 in the shooting direction.

Figure 6:
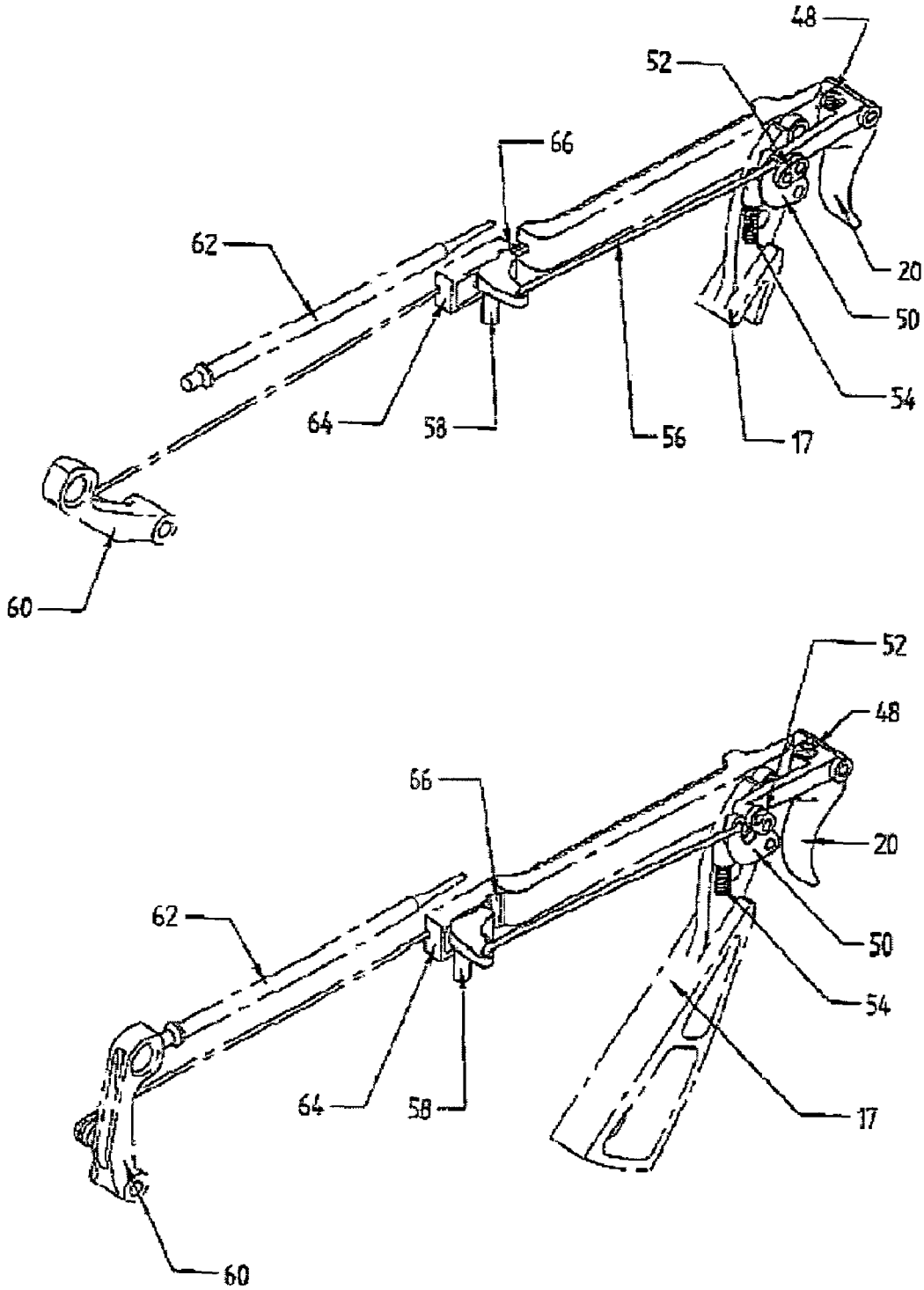
FIG. 6, details of the trigger assembly of FIG. 5 in the ready-to-fire state and in the fired state.

The trigger assembly 44 includes the trigger 20, which is formed as a catch-less toggle lever trigger, a trigger spring 48, a rocker arm 50, a chain 52, a compression spring 54, a connecting rod 56, and a trigger lug 58 (see FIG. 6). The trigger lug 58 is spatially separated from the toggle lever trigger and arranged behind this trigger in the shooting direction. The trigger lug 58 and the rocker arm 50 are connected by means of the connecting rod 56. In FIG. 6, additional components of the firing mechanism 46, namely a striker lever 60, an igniter 62, and a sliding block 64 are shown. In the ready-to-fire state shown at the top in FIG. 6, the trigger lug 58 engages in a holding catch 66 of the sliding block 64. In the fired state shown at the bottom in FIG. 6 the trigger lug 58 no longer engages in the holding catch 66 of the sliding block 64 and the cocking lever is no longer tensioned.

Figure 7:
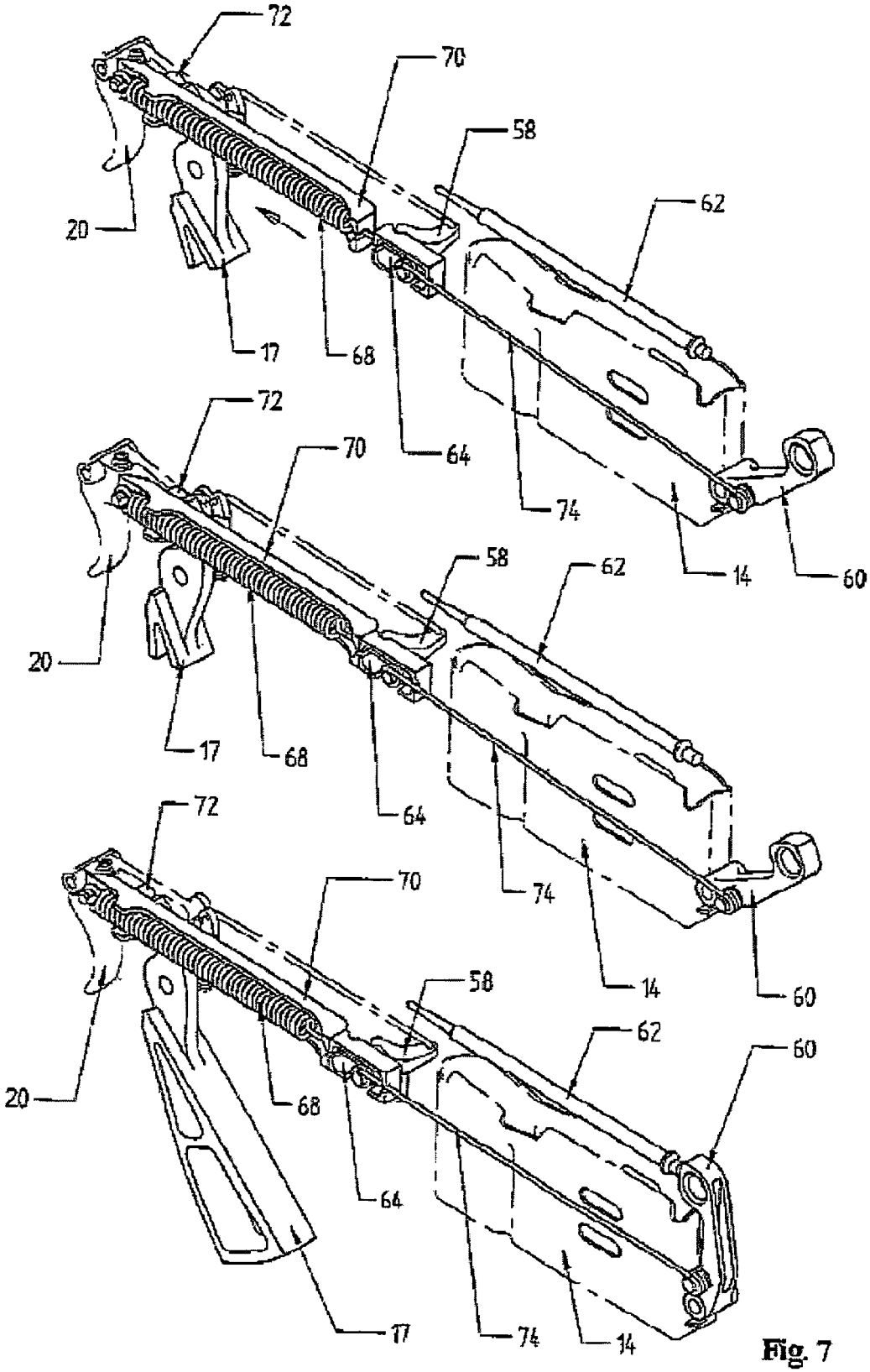
FIG. 7, details of the firing mechanism of FIG. 5 in the ready-to-fire state, in the loaded and secure state, and in the fired state.

FIG. 7 shows details of the firing mechanism 46 of FIG. 5 in the ready-to-fire state (top), in the secure state (middle), and also in the fired state (bottom). In addition to the components already mentioned above, the firing mechanism 46 has a striker spring 68, a tension slide 70, which is used in principle as a housing for the striker spring 68 and which sits flush on the sliding block 64, and a roller 72. The striker spring 68 is configured as a tension spring and thus without friction and is also used as a connection element (via connecting rod 74) between the cocking lever 60 and the sliding block 64.

In the ready-to-fire state, the striker spring 68 and the cocking lever 60 are tensioned. In the secure state, the cocking lever 60 is tensioned and the striker spring 68 is relaxed. In the fired state, the cocking lever 60 and the striker spring 68 are relaxed. This has the effect that the trigger assembly 44 and the firing mechanism 46 are configured such that the force of the striker spring 68 is held in the tensioned state by the trigger lug 58 in connection with the sliding block 64 behind the striker spring 68 and the striker spring 68 drives the cocking lever 60 via a connecting rod 74, and also the cocking lever 60 is brought into the striking position for a repeating process and is held in the striking position by the trigger lug 58 engaging in the holding lock 66 on the sliding block 64, wherein the striker spring 68 can be tensioned and relaxed by hand by the cocking lever.

The features of the invention disclosed in the preceding description, in the drawing, and also in the claims can be essential both individually and also in arbitrary combinations for the realization of the invention in its various embodiments.

LIST OF REFERENCE NUMBERS

10 Short repeater rifle
12 Main stock
14 Magazine
16 Pistol handle
17 Cocking lever
18 Trigger guard
20 Trigger
22 Forestock
24 Ridged grip
26 Lever
28 Barrel
30 Mount
32 Targeting telescope
34 Weapon base
36 Lock
38 Clamping screw
40 Nut
41 Clamping lever
42 Cartridge receiver
44 Trigger assembly
46 Firing mechanism
48 Trigger spring
50 Rocker arm
52 Chain
54 Compression spring
56 Connecting rod
58 Trigger lug
60 Striker lever

62 Igniter
64 Sliding block
66 Holding catch
68 Striker spring
70 Tension slide
72 Roller
74 Connecting rod

What is claimed is:

1. A short repeater rifle comprising:

a barrel including first and second ends having a center of length interposed between the first and second ends, the first end including a cartridge receiver and a locking system;

a trigger assembly including a trigger and a trigger guard attachable to the short repeater rifle and interposed between the first end and the center of length of the barrel, wherein the trigger is configured as a catch-less toggle lever trigger and the trigger assembly has a trigger lug, which is spatially separated from the toggle lever trigger, which is arranged behind this trigger in the shooting direction, and which is connected to the toggle lever trigger over a connecting rod;

a firing mechanism operably connected to the trigger assembly and interposed between the trigger assembly and the first end of the barrel;

a magazine engagable with the short repeater rifle between the first end of the barrel and the firing mechanism;

a weapon base detachably connected to the barrel between the trigger guard and the second end of the barrel; and a targeting device detachably connected to the barrel proximal to the weapon base, wherein the weapon base and targeting device are detachably connected to the barrel such that a center of gravity of the short repeater rifle lies in front of the trigger guard in a shooting direction.

2. Short repeater rifle according to claim 1, wherein the detachable connection of the barrel to the weapon base is interposed between the trigger guard and the center of the length.

3. Short repeater rifle according to claim 1, wherein the barrel is detachably connected to the weapon base by means of a prismatic clamping joint.

4. Short repeater rifle according to claim 1, wherein the barrel is detachably connected to the weapon base by a cylindrical clamping joint.

5. Short repeater rifle according to claim 1, wherein the barrel is detachably connected to the weapon base by a screw connection.

6. Short repeater rifle according to claim 1, characterized in that the drive of the firing mechanism is arranged in front of the magazine in the shooting direction.

7. Short repeater rifle according to claim 6, characterized in that the firing in mechanism has a cocking lever without a catch element.

8. Short repeater rifle according to claim 6, characterized in that the firing mechanism has a striker spring, which is configured as a tension spring.

9. A short repeater rifle comprising:

a barrel including first and second ends having a center of length interposed between the first and second ends, the first end including a cartridge receiver and a locking system;

a trigger assembly including a trigger and a trigger guard attachable to the short repeater rifle and interposed between the first end and the center of length of the barrel;

a firing mechanism operably connected to the trigger assembly and interposed between the trigger assembly and the first end of the barrel, wherein the firing mechanism has a striker spring, which is configured as a tension spring, and a sliding block with a holding catch, a connecting rod of arbitrary length, and a cocking lever, wherein the trigger assembly and the firing mechanism are configured so that the force of the striker spring is held in the tensioned state by the trigger lug in connection with the sliding block behind the striker spring and the striker spring drives the cocking lever via a connecting rod and also the cocking lever is brought into the striking position for a repeating process and is held in the striking position by the trigger lug engaging in the holding catch on the sliding block, wherein the striker spring can be tensioned and relaxed by hand by the cocking lever;

a magazine engagable with the short repeater rifle between the first end of the barrel and the firing mechanism, wherein a drive of the firing mechanism is arranged in front of the magazine in the shooting direction;

a weapon base detachably connected to the barrel between the trigger guard and the second end of the barrel; and a targeting device detachably connected the barrel proximal to the weapon base, wherein the weapon base and targeting device are detachably connected to the barrel such that a center of gravity of the short repeater rifle lies in front of the trigger guard in a shooting direction.

10. A short repeater rifle comprising:

a barrel including first and second ends having a center of length interposed between the first and second ends, the first end including a cartridge receiver and a locking system, the locking system includes a straight-line tension lock;

a trigger assembly including a trigger and a trigger guard attachable to the short repeater rifle and interposed between the first end and the center of length of the barrel;

a firing mechanism operably connected to the trigger assembly and interposed between the trigger assembly and the first end of the barrel;

a magazine engagable with the short repeater rifle between the first end of the barrel and the firing mechanism;

a weapon base detachably connected to the barrel between the trigger guard and the second end of the barrel; and a targeting device detachably connected the barrel proximal to the weapon base, wherein the weapon base and targeting device are detachably connected to the barrel such that a center of gravity of the short repeater rifle lies in front of the trigger guard in a shooting direction.

11. Short repeater rifle according to claim 10, characterized in that it has a forestock and the straight-line tension lock can be operated by means of a ridged grip on the forestock.

12. Short repeater rifle according to claim 10, characterized in that the straight-line tension lock can be operated by means of a lever that can be mounted on the left or right in the shooting direction.

* * * * *

UNITED STATES PATENT AND TRADEMARK OFFICE

CERTIFICATE OF CORRECTION

PATENT NO. : 7,047,684 B2
APPLICATION NO. : 10/716390
DATED : May 23, 2006
INVENTOR(S) : Horst Röh It is certified that error appears in the above-identified patent and that said Letters Patent is hereby corrected as shown below:

Title page,
Item [75], Inventor: please change the city “Eckemförde” to “Eckernförde”

Title page Item [73],Assignee: please change the city “Eckemförde” to “Eckernförde”

Signed and Sealed this

Fifth Day of September, 2006

JON W. DUDAS
*Director of the United States Patent and Trademark Office*